United States Patent [19]

Kadota

[11] Patent Number: 4,678,967

[45] Date of Patent: Jul. 7, 1987

[54] FLUORESCENT DISPLAY PANEL

[76] Inventor: Yoichi Kadota, c/o NEC Corporation, 33-1, Shiba 5-chome, Minato-ku, Tokyo, Japan

[21] Appl. No.: 708,676

[22] Filed: Mar. 6, 1985

[30] Foreign Application Priority Data

Mar. 6, 1984 [JP] Japan ..... 59-32025[U]

[51] Int. Cl.[4] ..... H01J 63/04

[52] U.S. Cl. ..... 313/497; 313/517

[58] Field of Search ..... 313/496, 497, 517, 516

[56] References Cited

FOREIGN PATENT DOCUMENTS

| | | | |
|---|---|---|---|
| 0106354 | 8/1981 | Japan | 313/496 |
| 0028163 | 2/1983 | Japan | 313/496 |
| 0096634 | 6/1984 | Japan | 313/497 |

*Primary Examiner*—Palmer C. DeMeo

[57] ABSTRACT

A display panel has an evacuated envelope with at least one transparent panel. Phosphor is deposited inside the panel at locations which are visible through the transparent panel. Two sets of electrodes are associated with the phosphor for locally controlling the brightness of the phosphor to give bright and dim displays, respectively, which are viewed through the transparent panel. The two displays are arranged to give a three dimensional appearance.

11 Claims, 8 Drawing Figures

FIG. 1
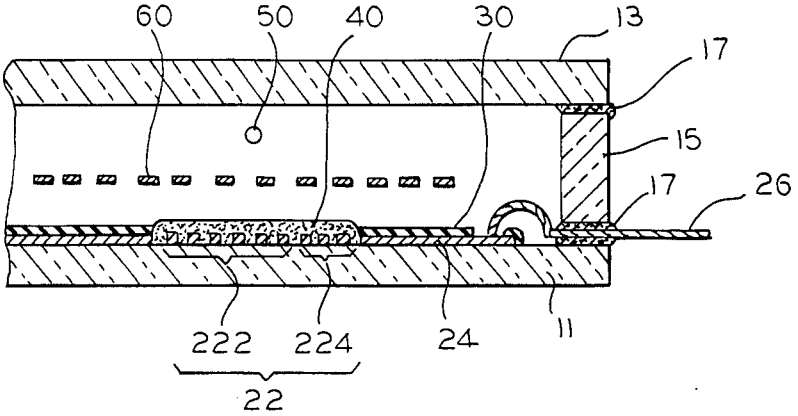
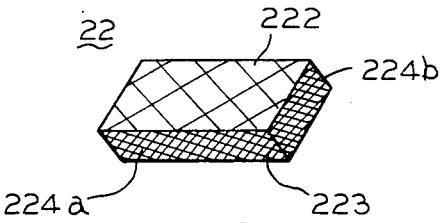
FIG. 2A
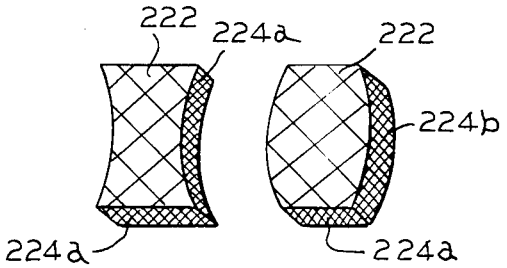
FIG. 2B
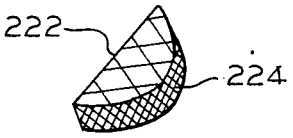
FIG. 2C
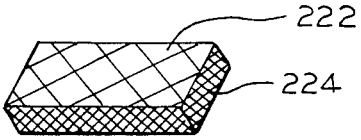
FIG. 2D
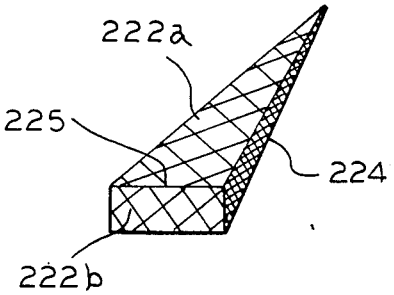
FIG. 2E

FLUORESCENT DISPLAY PANEL

BACKGROUND OF THE INVENTION

1. Field of the Invention

The present invention relates to a fluorescent display panel for giving a sense of perspective or relief image.

2. Description of the Prior Art

A typical form of fluorescent display panel includes an anode substrate having anode segments coated with phosphor, a cathode member placed over the anode segment, and a grid member disposed between the anode segments and the cathode member. A cover glass is secured to the anode substrate. Such a configuration is fully described by Takao Kishino in U.S. Pat. No. 4,047,073 (Patented on Sept. 6, 1977). In operation, only those anode segments which are held at a positive potential are excited to emit light by a bombardment of the electrons emitted from the cathode member and accelerated by the grid member potential. The emitted electrons display any shape of a display pattern according to the pattern of the anode segments such as a desired numeral, letter or figure.

Since such a display pattern is observed from the side of a cover glass, inevitably, it has a narrow viewing angle. To this end, a new structure has been developed such that the anode segment on a transparent substrate has a mesh structure to pass the light emitted from the phosphor coated thereon. Thus a display pattern can be observed from the side of the transparent substrate with a wide viewing angle. This new structure is reported by Y. Yoshida et al in "Latest Technology, in FIP" on pages 73 to 77 of SAE Technical paper 830045, delivered on Feb. 28, 1983. Although many improvements for a display quality have been made, the observable display pattern has been nothing but a plane figure. If the plane figure is turned into a figure appearing to be a solid, the display panel becomes more attractive.

SUMMARY OF THE INVENTION

It is an object of the present invention to provide a fluorescent display panel capable of giving a sense of perspective or relief image to a display pattern.

It is another object of the present invention to provide a fluorescent display panel having a wide viewing angle with an attractive display pattern giving a sense of high quality.

According to the pesent invention, a segment of a display pattern has a bright region and a dark or shadow region. The bright region is shaped to show a predetermined pattern. The shape of the shadow region is designed to cause a shading effect against the bright region and thereby give a sense of perspective or relief image.

To achieve the bright and shadow regions for a display segment, the corresponding anode segment has a mesh structure which is divided into a principal pattern for the bright region and a shading pattern for the shadow region. The principal pattern has a shape corresponding to a principal face of a solid figure drawn on a plane surface while the shading pattern has a shape corresponding to a side face thereof.

The transparency of the mesh of the shading pattern is less than the transparency of the mesh of the principal pattern. In other words, the mesh structure of the shading pattern has a smaller open area ratio than the mesh structure of the principal pattern has, so as to reduce the light passing therethrough. The mesh structure anode segment is provided on a transparent substrate and phosphor is provided on the mesh structure. When the phosphor is bombarded with electrons from a cathode member located above the phosphor, the light emitted from the phosphor is observed through the mesh structure and the transparent substrate. Preferably, the relative brightness of the shadow region, is in the range of 80% to 10% of the brightness from the principal pattern. More preferably, the range is 40% to 20%. The above value of 80% to 10% corresponds to about 8% to 75% of the ratio of open area of the shading pattern to the open area of the principal pattern, while the preferable values of 40% to 20% correspond to about 11% to 38% of the ratio of open area of the shading pattern to the open area of the principal pattern.

BRIEF DESCRIPTION OF THE DRAWINGS

FIG. 1 is a cross-sectional view of a part of a fluorescent display panel according to the present invention.

FIG. 2A to FIG. 2E are plan views of mesh structures of various anode segment shapes according to the present invention.

DESCRIPTION OF THE PREFERRED EMBODIMENTS

Figure 3:
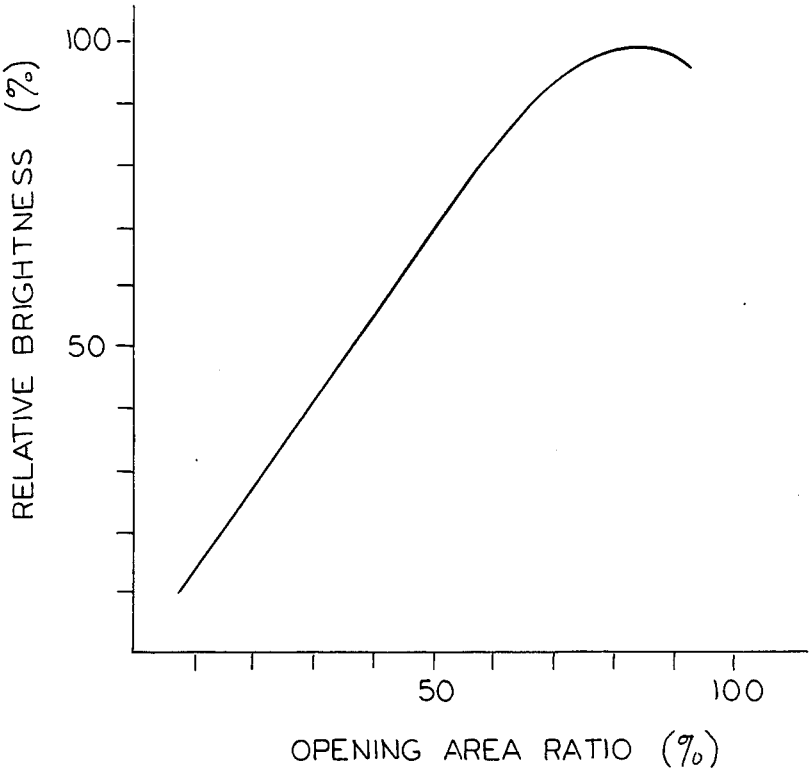
FIG. 3 is a characteristic graph between an opening area ratio of the mesh structure and relative brightness of light emitted from phosphor passing through the mesh structure.

Referring to FIG. 1, an anode electrode 20 is formed on a transparent substrate 11. The anode electrode 20 has a mesh structure display segment pattern 22 and wiring pattern 24, connected thereto. An insulative layer 30 is formed on the wiring pattern 24. Phosphor 40 is formed on the display segment pattern 22. A cathode member 50 extends over the phosphor 40. Grid member 60 is disposed between the phosphor 40 and the cathode member 50, in a conventional manner. Means for supporting the cathode and grid members are not shown, but they are within the skill of the art.

External lead member 26 is electrically connected to the terminal portion of the wiring pattern 24 and passes through a sealing portion of a vacuum envelop which is formed by the transparent substrate 11, a rear plate 13 and a spacer 15, again in a conventional manner. These components for the vacuum envelop are joined by sealing material 17.

The light emitted from the phosphor 40 is observed from the transparent substrate 11 through the mesh structure of the anode segment 22. Therefore, the observed display pattern corresponds to the shape of the anode segment 22.

According to the present invention, the observed display pattern is designed to have a shadow region adjacent to a bright region to give a sense of a perspective or relief image rather than a plane image, as shown in FIG. 2A to FIG. 2E and FIG. 4.

In order to give a sense of perspective or relief image, the relative brightness of the shadow region should be in the range of 80% to 10% of the brightness of the bright region.

When the relative brightness of the shadow region in the display pattern exceeds 80% of the brightness in the bright region, the relief image is weakened due to the low contrast between the bright and shadow regions. On the other hand, when the relative brightness of the shadow region is lower than 10% of the brightness in the bright region, it becomes difficult to identify it as the shadow region owing to the low contrast between the shadow region and the background.

To obtain two different degrees of relative brightness in a display pattern, the mesh structure of the anode segment 22 is divided into two regions. One bright main image region 222 is for the bright display of a principal pattern and the other dim shadow region 224 is for the shadow display of a shading pattern.

As used herein, a mesh structure refers to a structure having a large number of openings which are densly arrayed in a predetermined fine pattern. Needless to say, the shape of each opening is not restricted to a particular one. Any shape is available, such as a circular shape, a rectangular shape, a hexagonal shape, an elongated slit-like shape, or any other combination thereof.

The transparency factor of the mesh structure is determined by the ratio of the open area to the total area. This opening area ratio and the brightness level have a very close relationship. As might be expected, a small opening area ratio causes a higher light attenuation. However, a large opening area ratio does transmit more light. This large ratio will cause a higher anode resistance and hence less brightness. This relationship is shown in FIG. 3. An optimum mesh opening area ratio which yields the highest brightness exists at approximately 83%. For this reason, it is appropriate for the open area ratio of the principal pattern 222 to be in the range of approximately 80% to 85%.

According to experiments, the relative brightness of the shadow region should be in the range of about 80% to 10%, as descrbied hereinbefore. In this case, the open area ratio of the shading pattern is in the range of about 60% to 7% when the open area ratio of the principal pattern is in the range of about 80% to 85%. Therefore, the ratio of the open area of the shading pattern to the open area of the principal pattern is in the range of about 8% to 75%.

To cause an excellent sense of perspective, it is more preferable for the relative brightness of the shadow region to be in the range of 40% to 20% as compared with the brightness of the bright region. To this end, it is preferable for the open area ratio of the shading pattern to be in the range of approximately 10% to 30%. In this case, therefore, the ratio of the open area of the shading pattern to the open area of the principal pattern should be in the range of about 11% to 38% when the open area ratio of the principal pattern is in the range of 80% to 85%.

A typical example of significant portions in the present invention are as follows. The transparent substrate 11 is formed from a glass substrate having a thickness of 3 mm. The anode pattern 20 is a thin metal film such as aluminum film having a thickness of 1 to 1.5 microns, which is formed on the glass substrate 11 by a conventional thin film forming technique such as sputtering or vapor deposition. The desirable mesh structure 22 and wiring pattern 24 are formed by a photo etching technique. The mesh structure is formed somewhat like a honeycomb. The open area ratio of the principal pattern is 83% while the ratio of the shading pattern is 25%. In this case, the ratio of the open area ratio of the shading pattern to the ratio of the principal pattern is 30.1%. The insulative layer 30 of flint glass having a thickness of about 10 microns and a phosphor 40 of ZnO; Nz having thickness of 10 to 20 microns are formed by a screen printing technique or electric deposition as in a conventional manner, respectively.

As will be understood from the above description, since the present invention resides in a pattern for the mesh structure of anode display segment, materials and other configuration are arbitrary. Accordingly, the phosphor and anode metal are not restricted to the mentioned ones.

The transparency of the mesh structure of the opening area ratio can be easily controlled by selecting the width of a frame forming each of the openings as shown in FIG. 1. When the width of each frame increases without changing the number of openings, the transparency decreases, and thus the open area ratio decreases. It is also possible to decrease the open area ratio by increasing the number of openings without changing the width of each frame, so as to make the mesh of the shading pattern more dense than the mesh of the principal pattern.

Furthermore, any shape of the principal pattern 222 is possible and the shading pattern 224 can be appropriately designed to give a sense of perspective, relief image or three-dimensional image as shown in FIG. 2A to FIG. 2E.

In FIG. 2A, the mesh structure of the anode segment 22 has a principal pattern 222 in the shape of a parallelogram and a pair of shading pattern **224*a* and 224*b* along the side edges of the principal pattern 222**.

Needless to say, the shape of the principal pattern 222 is arbitrary, for example, a pin cushion shape, barrel shape and a semi-circular shape as shown in FIG. 2B and FIG. 2C. In any shape of the principal pattern 222, the shading pattern is provided adjacent to the principal pattern 222 to cause a shading effect.

In FIG. 2A and FIG. 2B, although the shading pattern is divided into two regions **224*a* and 224*b* by a boundary line 223, such boundary line can be omitted as shown in FIG. 2D. On the other hand, the shape of the principal pattern 222 can be divided into two regions 222*a* and 222*b* by a boundary line 225** with a single shading pattern as shown in FIG. 3E. It is preferable for the width of a boundary line between the principal pattern and the shading pattern to be as small as possible, in the order of 30 microns, so as to be seen successively.

In this manner, it is apparent that the shape of the anode segment is not restricted to the exemplary shades shown in FIG. 2A to FIG. 3E. Any other shape and combination of shades is possible.

Figure 4:
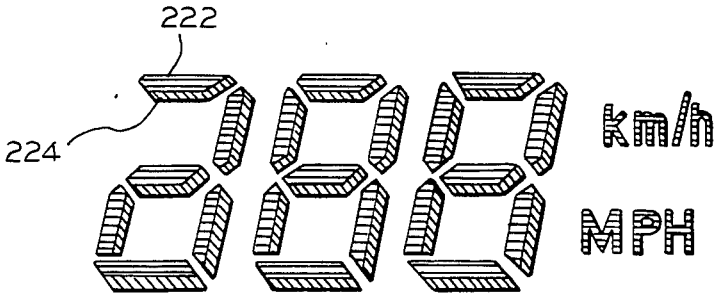
FIG. 4 is a plan view of a specific example of the present invention used for displaying the reading of an automobile speedometer.

FIG. 4 shows a specific design of the anode display segment used for a speedometer on an automobile. In this embodiment, a numerical display from 0 to 399 can be achieved by a segment array of two figure-of-eight patterns and a figure-of-a pattern. Each of these segments for displaying a numerical number is divided into two regions of a principal bright main image region 222 and a dim shadow image region 224 in the same manner as shown in FIG. 2D. For the display of the unit of speed, the anode segments of Km/h and MPH are provided at right side of the numerical number and their mesh structure is designed in the conventional manner without providing shading pattern. In this embodiment, by giving a sense of perspective to only a significant portions among all display patterns, an impressive display can be achieved to give a sense of a high quality image on a fluorescent display panel with a wide viewing angle. The brightness of the speed unit portions is arbitrary, thus the open area ratio is also arbitrary.

It will be apparent to those skilled in the art that the invention is not restricted to the features described above and shown in the drawings but may be varied in many ways within the scope of the annexed claim.

What is claimed is:

1. A fluorescent display panel comprising: a transparent substrate having an anode segment formed thereon, said anode segment having phosphor provided thereon, said phosphor being excitable to emit light responsive to an electron bombardment thereof, means for forming a vacuum envelope enclosing said anode segment and phosphor, and means positioned above said phosphor for producing said electron bombardment within said envelope, said anode segment having first and second regions adjacent each other to pass predetermined amounts of said light therethrough, said second region of said anode forming a dim shadow image region of said light, said first region of said anode forming a bright main image region of said light, said shadow image and said bright main image forming a combined display pattern of bright and dim light observed through said transparent substrate, said dim shadow image of light being a reduced amount of said light which gives a sense of perspective to said bright light in said display pattern.

2. The panel of claim 1, wherein the relative brightness of said dim shadow image is in the range of 80% to 10% of the brightness of said bright main image region.

3. The panel of claim 1, wherein said anode segment has a large number of densely arrayed openings and said second anode region has a smaller open area ratio than the corresponding ratio of said first anode region.

4. The panel of claim 3, wherein ratio of said open area ratio of said second region to the open area ratio of said first region is in the range of 8% to 75%.

5. A fluorescent display panel comprising: an anode substrate which is within a part of a vacuum envelope forming said display panel; a pattern of anode segments mounted on an inner principal surface of said anode substrate; said anode substrate being transparent and said anode segments having first and second regions of different mesh structures, phosphor provided on said anode segments to emit light in response to an electron bombardment thereof; a cathode member extending over said anode substrate and said anode segments; a grid member disposed between said anode segments and said cathode member; and means for forming said vacuum envelope to enclose said anode segment, phosphor, cathode member and grid member within said envelope; said first and second regions of mesh structures being adjacent each other, said second anode region having an open area ratio which is smaller than the open area ratio of said first region to give a sense of perspective for the display of a unified pattern observed through said anode substrate.

6. A fluorescent display panel comprising: a transparent plate which is a part of and within a vacuum envelope forming said display panel, an anode segment provided on an inner principal surface of said transparent plate, said anode segment having a mesh structure which passes light therethrough, phosphor provided on said anode segment to emit said light in response to an electron bombardment, means for forming said vacuum envelope to enclose said anode segment and phosphor within said envelope, and means located above said phosphor for producing said electron bombardment within said vacuum envelope, said mesh structure being divided into first and second regions, said second region being adjacent said first region and being more transparent than said first region so as to cause a combined display pattern of a relief or solid image.

7. A display panel comprising an evacuated envelope having at least one transparent plate, phosphor material inside said envelope at locations which are viewed through said transparent plate, electrodes provided between said phosphor and said panel for locally controlling the brightness of said phosphor, there being at least two sets of said electrodes for locally giving bright and dim display, respectively, and means located above said phosphor for bombarding said phosphor to give off electrons for providing an illuminated display of an image viewed through said electrodes and said transparent plate.

8. The panel of claim 7 wherein said two sets of electrodes have open areas which have different ratios of openness to provide said bright and dim displays.

9. The panel of claim 8 wherein the set of electrodes giving said dim display are positioned adjacent the set of electrodes giving said bright display, the pattern of the two sets of electrodes causing three dimensional display of said image.

10. The panel of claim 9 wherein at least one image displayed through said panel is controlled by only one set of said electrodes to give only a two dimensional display.

11. The panel of claim 9 wherein the set of electrodes giving the dim display are positioned adjacent the set of electrodes giving the bright display, and the pattern of the two sets of electrodes causes three dimensional display of the image.

* * * * *

UNITED STATES PATENT AND TRADEMARK OFFICE

CERTIFICATE OF CORRECTION

PATENT NO. : 4,678,967

DATED : July 7, 1987

INVENTOR(S) : YOICHI KADOTA

It is certified that error appears in the above-identified patent and that said Letters Patent is hereby corrected as shown below:

ON THE TITLE PAGE INSERT:

--NEC Corporation, Japan--.

Signed and Sealed this

Sixteenth Day of February, 1988

*Attest:*

DONALD J. QUIGG

*Attesting Officer*

*Commissioner of Patents and Trademarks*